US007669432B2

(12) United States Patent
Maier et al.

(10) Patent No.: US 7,669,432 B2
(45) Date of Patent: Mar. 2, 2010

(54) EVAPORATOR PRESSURE REGULATOR CONTROL AND DIAGNOSTICS

(75) Inventors: Albert W. Maier, St. Charles, MO (US); John R. Aggers, Canton, GA (US); Robert A. Kensinger, Creve Coeur, MO (US); Richard P. Vogh, III, Marietta, GA (US); Timothy D. Campbell, Rockmart, GA (US); Scott M. Gelber, Kennesaw, GA (US)

(73) Assignee: Emerson Retail Services, Inc., Kennesaw, GA (US)

( * ) Notice: Subject to any disclaimer, the term of this patent is extended or adjusted under 35 U.S.C. 154(b) by 130 days.

(21) Appl. No.: 11/874,506

(22) Filed: Oct. 18, 2007

(65) Prior Publication Data

US 2008/0034771 A1 Feb. 14, 2008

Related U.S. Application Data

(62) Division of application No. 11/081,083, filed on Mar. 15, 2005, now Pat. No. 7,287,396.

(60) Provisional application No. 60/553,053, filed on Mar. 15, 2004.

(51) Int. Cl.
*F25B 41/04* (2006.01)
*G05D 23/12* (2006.01)
*F16K 31/02* (2006.01)

(52) U.S. Cl. ..... 62/222; 236/92 B; 251/129.05

(58) Field of Classification Search ..... 62/222; 236/92 B; 251/129.01, 129.05
See application file for complete search history.

(56) References Cited

U.S. PATENT DOCUMENTS

| | | | | |
|---|---|---|---|---|
| 4,475,686 | A | 10/1984 | Huelle et al. | |
| 5,000,009 | A | 3/1991 | Clanin | |
| 5,153,522 | A * | 10/1992 | Sano | 324/546 |
| 5,316,263 | A | 5/1994 | Mino | |
| 5,684,371 | A * | 11/1997 | Tarui et al. | 318/400.29 |
| 5,743,098 | A | 4/1998 | Behr | |
| 5,867,995 | A | 2/1999 | Lewis | |
| 6,047,557 | A | 4/2000 | Pham et al. | |
| 6,360,553 | B1 | 3/2002 | Singh et al. | |
| 6,408,635 | B1 * | 6/2002 | Pham et al. | 62/222 |
| 7,287,396 | B2 | 10/2007 | Maier et al. | |
| 2003/0080306 | A1 * | 5/2003 | Yoeda et al. | 251/129.16 |

FOREIGN PATENT DOCUMENTS

CN 1477356 2/2004

OTHER PUBLICATIONS

Examiner's First Report received from IP Australia regarding Application No. 2005223023 dated Mar. 25, 2009.

* cited by examiner

*Primary Examiner*—Marc E Norman
(74) *Attorney, Agent, or Firm*—Harness, Dickey & Pierce, P.L.C.

(57) ABSTRACT

A method includes cycling an electronic evaporator pressure regulator valve fluidly coupled to a refrigeration circuit to regulate flow through the electronic evaporator pressure regulator valve and sensing a current drawn by the electronic evaporator pressure regulator valve during cycling of the electronic evaporator pressure regulator valve. The method further includes determining a valve condition of the electronic evaporator pressure regulator valve based on the sensing.

12 Claims, 6 Drawing Sheets

EVAPORATOR PRESSURE REGULATOR CONTROL AND DIAGNOSTICS

CROSS-REFERENCE TO RELATED APPLICATIONS

This application is a divisional of U.S. patent application Ser. No. 11/081,083 filed on Mar. 15, 2005, which claims the benefit of U.S. Provisional Application No. 60/553,053 filed on Mar. 15, 2004. The disclosures of the above applications are incorporated herein by reference.

FIELD

The present teachings relate generally to a method and apparatus for refrigeration system control and diagnostics and, more particularly, to a method and apparatus for refrigeration system control and diagnostics using evaporator pressure regulators.

BACKGROUND

A conventional refrigeration system may include a rack of multiple compressors connected to several refrigeration circuits. A refrigeration circuit is defined generally as a physically plumbed series of cases operating at the generally same pressure and/or temperature. For example, in a grocery store, separate refrigeration circuits may exist for frozen food, meats and dairy, with each circuit having one or more cases operating at similar temperature ranges, and the circuits operating in different temperature ranges. The temperature differences between the circuits are typically achieved by using mechanical evaporator pressure regulators (EPR) valves or other valves located in series with each circuit. Each EPR valve regulates the pressure for all the cases in a given circuit. The pressure at which the EPR valve controls the circuit is typically set during system installation, or recalibrated during maintenance, using a mechanical pilot screw disposed in the valve. The circuit pressure is selected based on a pressure drop between the cases on the circuit, the rack suction pressure, and case temperature requirements.

The multiple compressors are connected in parallel using a common suction header and a common discharge header to form a compressor rack. The suction pressure for the compressor rack is determined by modulating each of the compressors between an ON state and an OFF state in a controlled fashion. The suction pressure set point for the compressor rack is generally set to a value that can meet the lowest evaporator circuit requirement. In other words, the circuit that operates at the lowest temperature generally controls the suction pressure set point, which is fixed to meet the refrigeration capacity requirements of that lowest temperature.

Case temperature requirements generally change throughout the year due to ever-changing outside temperature conditions. For example, in the winter, there is generally a lower case load, which may require a higher suction pressure set point. Conversely, in the summer, there is generally a higher load, which may require a lower suction pressure set point. Cost savings from efficiency gains may be realized by seasonally adjusting EPR valves to tailor the output of the refrigeration system to that which is required to meet the seasonal case load. By changing the EPR valves, the suction pressure set point of the compressor rack is adjusted to effect refrigeration system output. Because adjustments to the EPR valves typically require a refrigeration technician, such adjustments are seldom performed on-site due to cost and time constraints.

Electronic EPR valves, such as those disclosed in Assignee's U.S. Pat. Nos. 6,360,553; 6,449,968; 6,601,398; and 6,578,374, each of which is incorporated herein by reference, do not suffer from the above-mentioned disadvantages. The EPR valves provide adaptive adjustment of the evaporator pressure for each circuit, resulting in a more accurate and stable case temperature, but require a separate driver for each EPR valve.

SUMMARY

A method includes cycling an electronic evaporator pressure regulator valve fluidly coupled to a refrigeration circuit to regulate flow through the electronic evaporator pressure regulator valve and sensing a current drawn by the electronic evaporator pressure regulator valve during cycling of the electronic evaporator pressure regulator valve. The method further includes determining a valve condition of the electronic evaporator pressure regulator valve based on the sensing.

Further areas of applicability of the present teachings will become apparent from the detailed description provided hereinafter. It should be understood that the detailed description and specific examples, while indicating the preferred embodiment of the teachings, are intended for purposes of illustration only and are not intended to limit the scope of the teachings.

BRIEF DESCRIPTION OF THE DRAWINGS

The present teachings will become more fully understood from the detailed description and the accompanying drawings, wherein.

DETAILED DESCRIPTION

The following description concerning a method and apparatus for refrigeration system control using electronic evaporator pressure regulators is merely exemplary in nature and is not intended to limit the teachings or its application or uses. Moreover, while the present teachings are discussed in detail below with respect to specific types of hardware, the present teachings may employ other types of hardware which are operable to be configured to provide generally the same control as discussed herein. For example, the present teachings are described in association with a refrigeration system, but are equally applicable to other systems including air conditioning, chiller, cryogenic heat pump and transportation, among others.

Figure 1:
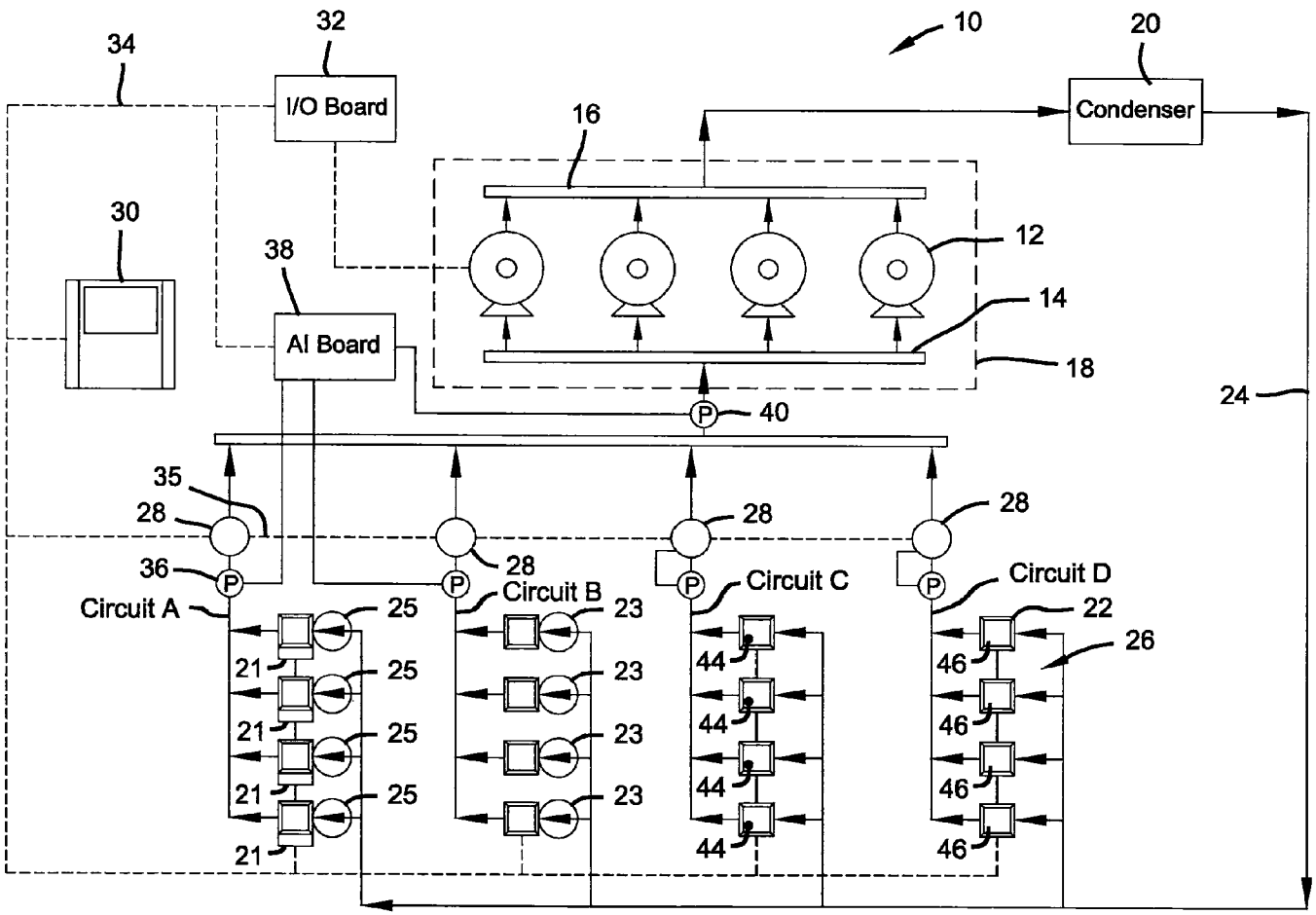
FIG. 1 is a block diagram of a refrigeration system employing a method and apparatus for coding system control according to the teachings of the present teachings.

Referring to FIG. 1, a detailed block diagram of a refrigeration system 10 according to the present teachings is shown. The refrigeration system 10 includes a plurality of compressors 12 piped together with a common suction manifold 14 and a discharge header 16 all positioned within a compressor rack 18. The compressor rack 18 circulates refrigerant through the refrigeration system 10 and in so doing, delivers vaporized refrigerant at high pressure to a condenser 20. The condenser 20 receives the vaporized refrigerant from the compressor rack 18 and liquefies the vaporized refrigerant at high pressure.

High-pressure liquid refrigerant is delivered from the condenser 20 to a plurality of refrigeration circuits 26 by way of piping 24. Each refrigeration circuit 26 includes at least one refrigeration case 22 that operates within a similar temperature range as other refrigeration cases 22 within the same circuit 26. FIG. 1 illustrates four (4) circuits 26 labeled Circuit A, Circuit B, Circuit C and Circuit D. Each circuit 26 is shown consisting of four (4) refrigeration cases 22. However, those skilled in the art will recognize that a refrigeration system may include any number of circuits 26, and that any number of refrigeration cases 22 may be included within a circuit 26. Each circuit 26 will generally operate within a certain temperature range. For example, Circuit A may be for frozen food, Circuit B may be for dairy, Circuit C may be for meat, etc.

Each circuit 26 includes a pressure regulator, preferably an electronic stepper regulator (ESR) valve assembly 28, which acts to control the evaporator pressure and hence, the temperature of the refrigerated space in the refrigeration cases 22. Each ESR valve assembly 28 generally includes a valve 110 and may further include a control and diagnostic unit (CDU) 132. Each ESR valve 28 may include an individual CDU 132 or, alternatively, an individual CDU 132 may be arranged to control multiple ESR valve assemblies 28. The ESR valve assemblies 28 are connected to one another in a daisy chain circuit 35 via communication lines 200.

For case temperature control, each refrigeration case 22 includes an evaporator and an expansion valve, which may be either a mechanical or an electronic valve for controlling the superheat of high-pressure liquid refrigerant flowing through the evaporator in each refrigeration case 22. The refrigerant passes through the expansion valve where a pressure drop occurs to change the high-pressure liquid refrigerant to a lower-pressure combination of liquid and vapor. As the relatively warm air from the refrigeration case 22 moves across the evaporator, the low pressure liquid turns into gas, which is delivered to the ESR valve assembly 28 associated with that particular circuit 26.

At ESR valve assembly 28, the pressure is dropped in accordance with a position of valve 110 as the gas returns to the compressor rack 18. The position of valve 110 is determined by case and/or circuit conditions, which are analyzed by a control algorithm to output a valve position signal. At the compressor rack 18, the low pressure gas is again compressed to a higher pressure and delivered to the condenser 20 to repeat the refrigeration cycle.

The control algorithm may be executed by a main refrigeration controller 30 or the CDU 132 to control a position of each respective valve 110. In addition, the main refrigeration controller 30 or CDU 132 may also control the suction pressure set point for the entire compressor rack 18. The refrigeration controller 30 is preferably an Einstein Area Controller offered by CPC, Inc. of Atlanta, Ga., or any other type of programmable controller, which may be programmed, as discussed herein. The refrigeration controller 30 controls the bank of compressors 12 in the compressor rack 18 via an input/output board 32. The input/output board 32 has relay switches to operate the compressors 12 to provide the desired suction pressure.

With reference to Circuit A of FIG. 1, a separate case controller 21, such as a CC-100 case controller, also offered by CPC, Inc. of Atlanta, Ga. may be used to control the superheat of the refrigerant to each refrigeration case 22. The case controller 21 may cooperate with an electronic expansion valve 25 associated with each refrigeration case 22 by way of a communication network or bus 34. The network/bus 34 may be any suitable communication platform such as a RS-485 communication bus, a LonWorks Echelon bus, or a wireless network, enabling the main refrigeration controller 30 and the separate case controllers 21 to receive information from each case 22. With reference to Circuit B of FIG. 2, a mechanical expansion valve 23 may be used in place of the case controller 21 and electronic expansion valve 25.

In order to monitor the pressure in each circuit 26, a pressure transducer 36 may be provided at each circuit 26 and positioned at the output of the bank of refrigeration cases 22 or adjacent to the ESR valve assembly 28. Each pressure transducer 36 delivers an analog signal to an analog input board 38 associated with the main refrigeration controller 30 or an analog input 189 associated with the CDU 132 of the ESR valve assembly 28. For either arrangement, the analog input board 38 or analog input 189 measures the analog signal and sends data to the main refrigeration controller 30 or CDU 132 of the ESR valve assembly 28, respectively. Alternatively, a wireless network may be used to communicate the pressure values. Also provided is a pressure transducer 40, which measures the suction pressure for the compressor rack 18 and provides an analog signal to the analog input board 38 via the communication bus 34 or via a wireless network.

In order to vary the position of each valve 110 assembly 28, the main refrigeration controller 30 may send valve position signals to a driver circuit of CDU 132 for each ESR valve assembly 28, which are in communication with the main refrigeration controller 30 through a daisy chain circuit 35 connected to the communication bus 34. Alternatively, the pressure transducer 36 for each circuit 26 may provide an analog signal to the CDU 132 of the ESR valve assembly 28, which runs a control algorithm to determine a position of valve 110, which then may be driven by the driver circuit of CDU 132. The position of valve 110 may be communicated to the main refrigeration controller 30 via the daisy chain circuit 35, communication bus 34, and/or a wireless network.

As opposed to using a pressure transducer 36 to control an ESR valve assembly 28, ambient temperature inside the cases 22 may be also be used to control the position of each valve 110. In this regard, Circuit C is shown having temperature sensors 44 associated with each individual refrigeration case 22. Each refrigeration case 22 in Circuit C may have a separate temperature sensor 44 to take average/minimum/maximum temperatures used to control the ESR valve assembly 28 or a single temperature sensor 44 may be used in one refrigeration case 22 within Circuit C, as all of the refrigeration cases in a circuit 26 operate at substantially the same temperature range. These temperature inputs may be provided to the analog input board 38, which returns the information to the main refrigeration controller 30 via the communication bus 34.

The main refrigeration controller 30 then sends valve position signals to control valve 110 via its associated CDU 132. Alternatively, temperature inputs may be provided directly to the CDU 132, which runs a control algorithm to determine a valve position driven by the driver circuit. Again, the position of valve 110 may be communicated to the main refrigeration controller via the daisy chain circuit 35, communication bus 34, and/or a wireless network.

As opposed to using an individual temperature sensor 44 to determine the temperature for a refrigeration case 22, a temperature display module 46 may alternatively be used, as shown in Circuit D. The temperature display module 46 is preferably a TD3 Case Temperature Display, also offered by CPC, Inc. of Atlanta, Ga., and described more fully in U.S. Pat. Nos. 6,502,409 and 6,378,315, each of which is expressly incorporated herein by reference. In this regard, the display module 46 will be mounted in each refrigeration case 22. Each module 46 is designed to measure multiple temperature signals, including case discharge air temperature, a simulated product temperature, and a defrost termination temperature. These sensors may also be interchanged with other sensors, such as a return air-sensor, an evaporator-temperature sensor, or a clean-switch sensor.

The simulated product temperature may be provided by a Product Probe, also offered by CPC, Inc., of Atlanta, Ga., and described in the above-referenced patents. As with pressure and temperature sensors described above, the temperature display module 46 may provide a signal to the main refrigeration controller 30, which in turn communicates position signals to the CDU 132. Alternatively, the temperature display module 46 may determine control signals independently and directly control the valve 110, or may provide signals to the CDU 132, which runs a control algorithm to determine the position of valve 110. The CDU 132 may then communicate the determined valve position to the main refrigeration controller 30 via the daisy chain circuit 35, communication bus 34, and/or a wireless network.

Figure 2:
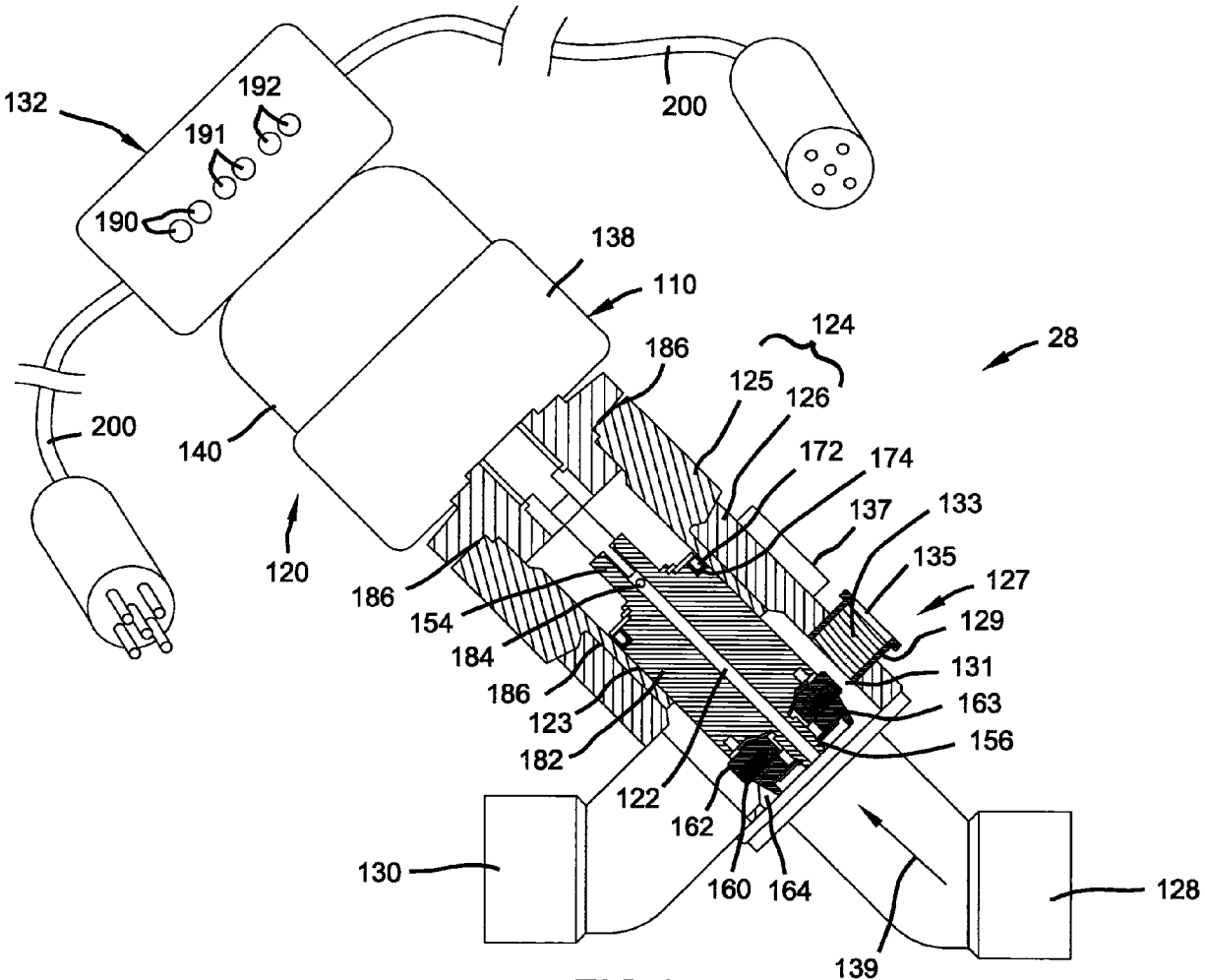
FIG. 2 is a partially-sectioned side view of an ESR valve according to the teachings of the present teachings.
Figure 4:
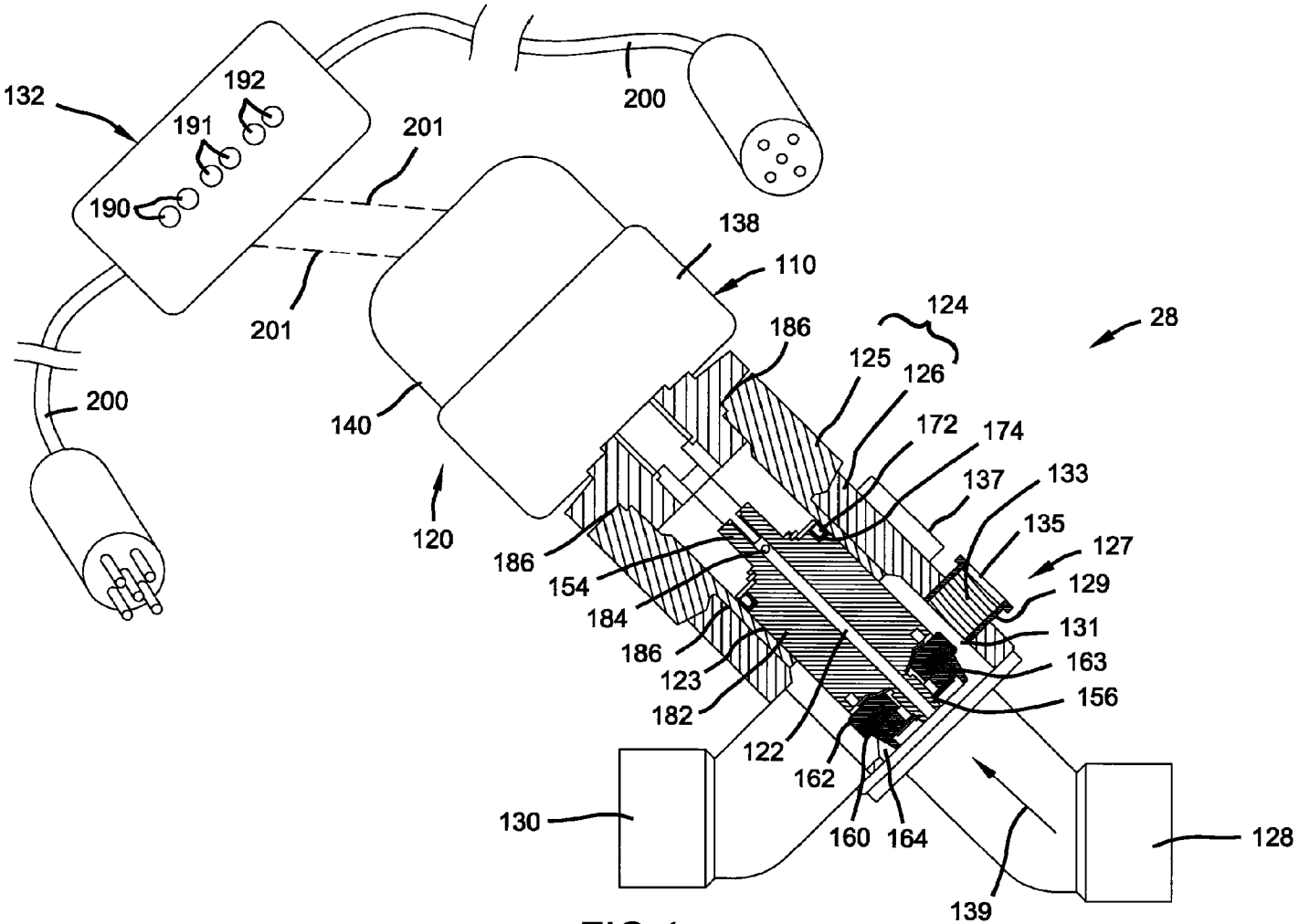
FIG. 4 is a partially-sectioned side view of another ESR valve according to the teachings of the present teachings.

FIGS. 2 and 4 illustrate the valve 110, which generally includes a motor assembly 120 and a body 124 that defines an axial opening 123 adapted to receive a piston 122. The piston 122 is linearly moveable, bi-directionally, in the body 124. The body 124 may include a bell 125 and a tube portion 126, as well as a sight glass 127 and a Hall Effect sensor 137. The motor assembly 120 of the fluid control device 110 is powered and controlled by the CDU 132.

Fluid flows from and to the valve 110 via an inlet 128 and an outlet 130, respectively. An arrow 131 indicates the direction of fluid flow through the valve 110. Configuring the inlet 128 such that fluid enters the valve 110 from the bottom, as shown in FIGS. 2 and 4, minimizes pressure losses. In the embodiment of FIGS. 2 and 4, the inlet 128 includes an inlet tube and the outlet 130 includes an outlet tube. The inlet tube and outlet tube cooperate with the body 124 to form a passageway for fluid flow. The inlet 128 and the outlet 130 may be considered a part of the body 124. The tube body 126 of the body 124 is sealably connected to the inlet 128 and the outlet 130 in any suitable manner known to the art. Typically, the tube body 126 may be joined to the inlet tube 128 and to the outlet tube 130 by either sweating or soldering the connections. The seal is important to prevent the fluid from leaking out of the system as will be apparent to those in the art having the benefit of this disclosure.

The sight glass 127 allows visual verification of operation of the ESR valve assembly 28. For example, glass 127 provides verification of valve position and allows easy inspection for suction debris, which are common at system startup. The sight glass 127 generally includes a body 129 threadably engaged in an aperture 131 of tube portion 126. The body 129 defines a cylindrical opening therethrough and mounts a lens 135 in the opening 133 to provide visual inspection. The body 129 includes threads matingly received by the aperture 131 to secure the sight glass 127 in place.

Figure 3:
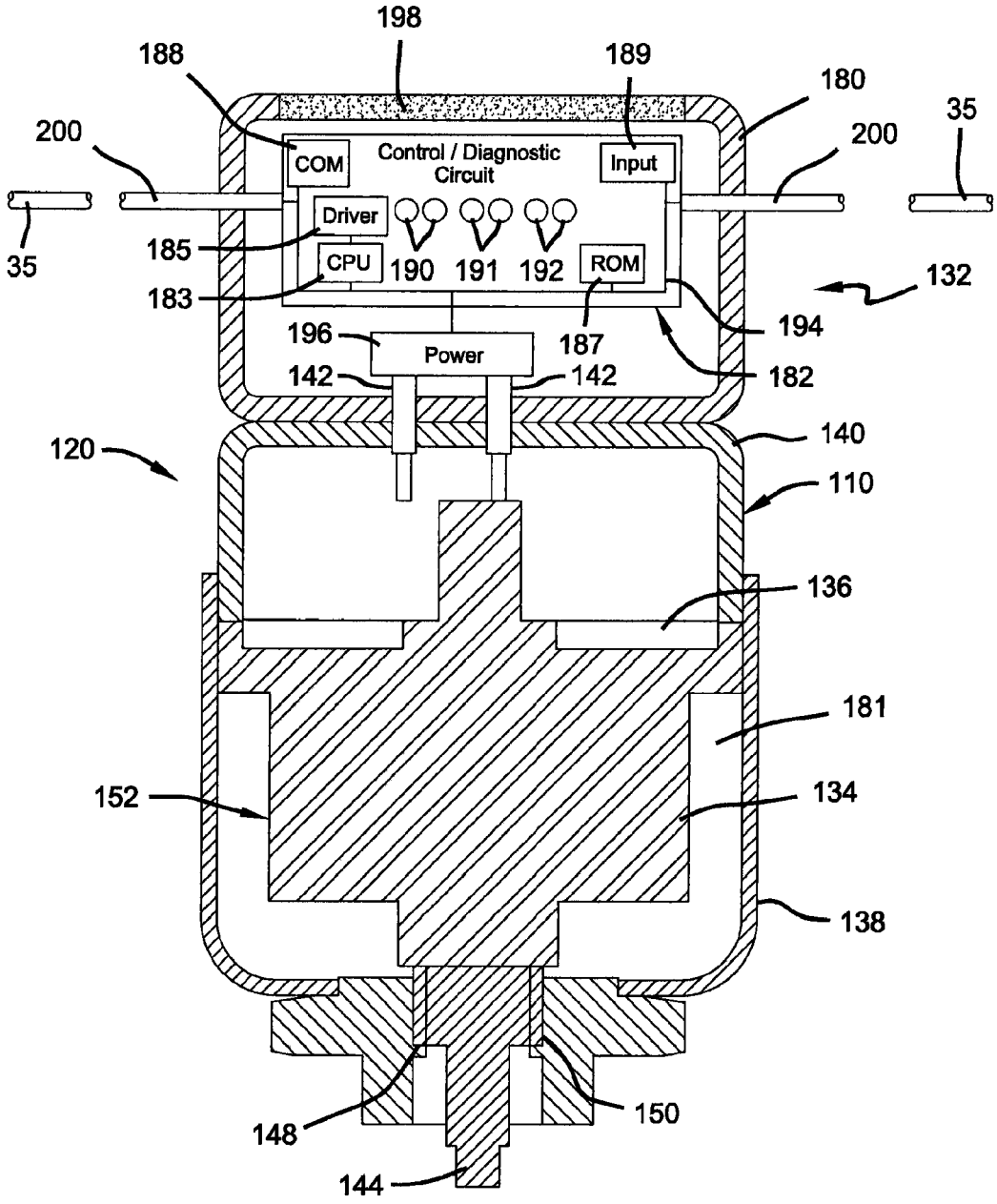
FIG. 3 is a sectioned side view and schematic of the motor and controller of the ESR valve of FIG. 2.
Figure 5:
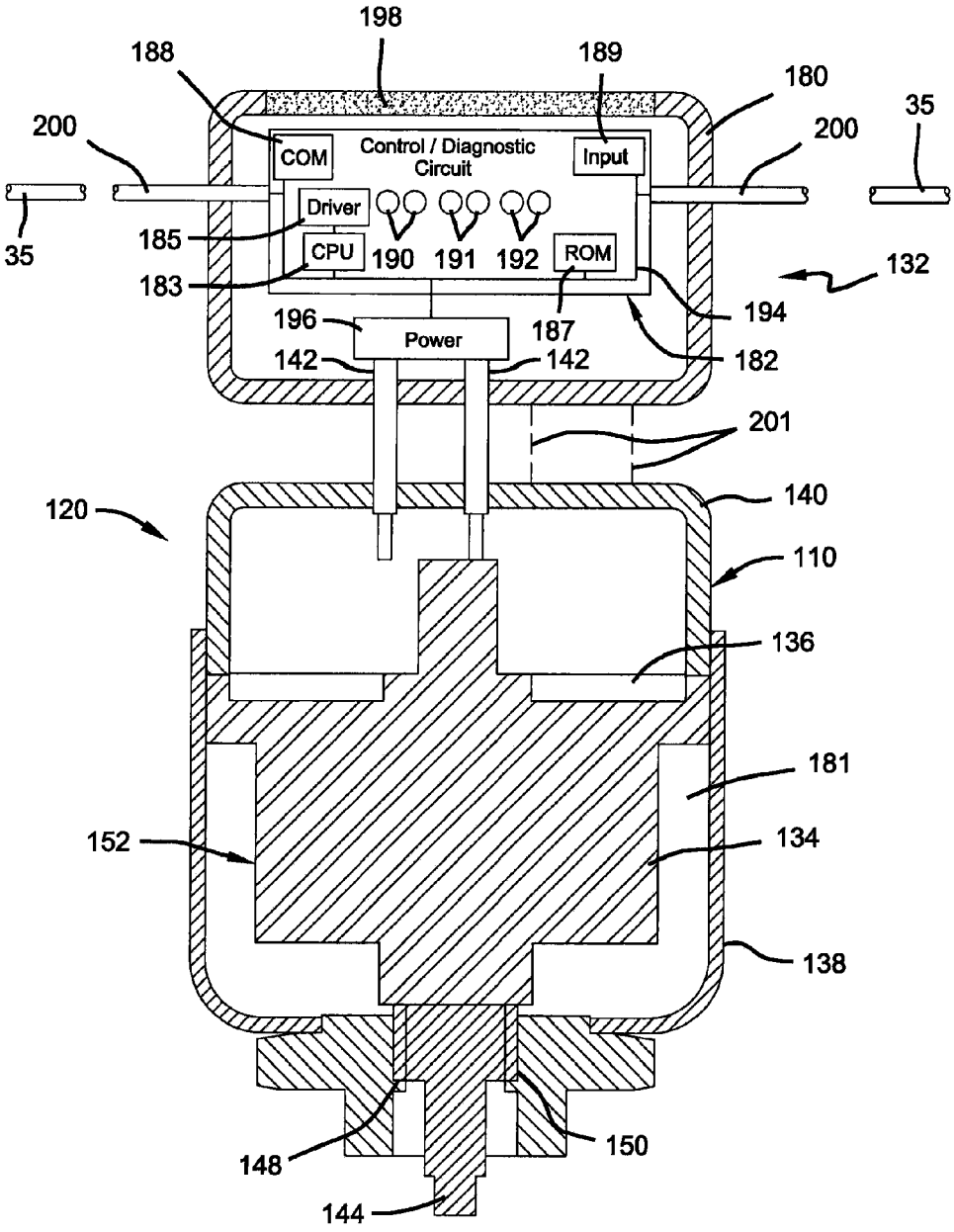
FIG. 5 is a sectioned side view and schematic of the motor and controller of the ESR valve of FIG. 4.
Figure 6:
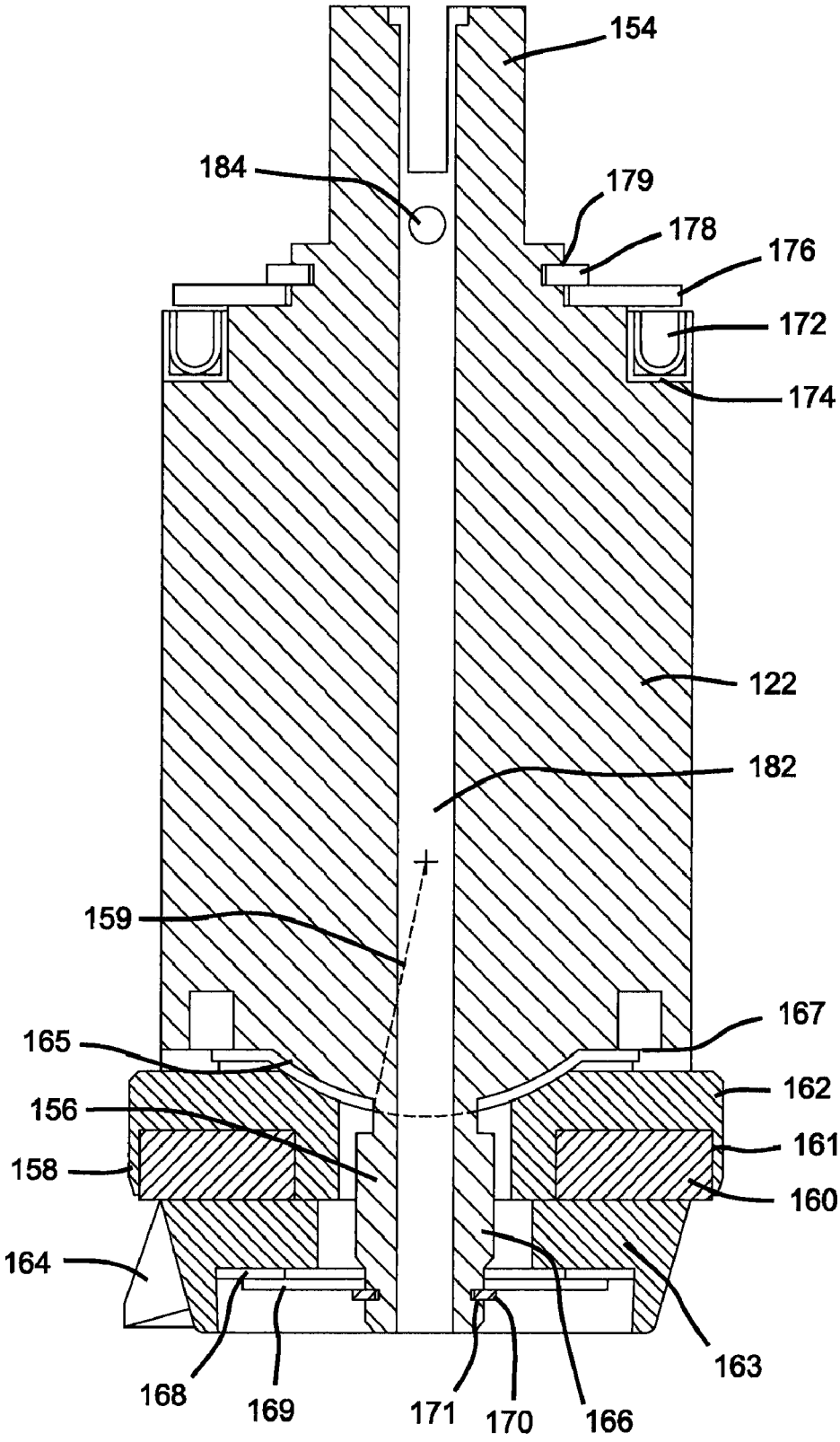
FIG. 6 is a sectioned side view of the valve of the ESR of FIG. 2.

Referring now to FIGS. 3 and 5, the motor assembly 120 and CDU 132 of the ESR valve assembly 28 are illustrated in greater detail. The motor assembly 120 generally includes a motor 134 mounted to a weld spacer 136 that is affixed to a motor housing 138. The housing 138 is closed by a top cap assembly 140, which includes electrically conductive pins 142 through which power received via the CDU 132 is supplied to the motor 134 as shown in FIGS. 2 and 4. The top cap assembly 140 may be integrated with the CDU 132, or as a separate component as shown. The motor 134 drives a pinion shaft 144 that, although not shown, is threaded. The pinion shaft 144 extends through an opening 148 of a nut 150 threadably connected to the bottom of the housing 138. The motor 134 and pinion shaft 144 include an actuator 152 for providing a linear force to the piston 122.

As shown, the motor 134 is a linear actuating bipolar stepper motor, but may alternatively be a unipolar stepper motor. The motor 134 moves the piston 122 in discrete increments to modulate the flow of refrigerant as required to control temperature. A stepper motor provides discrete control, and requires only minimal electrical power when moving the piston 122 and no electrical power when holding the piston 122 in a static position. The motor may be a two-phase bipolar stepper motor operating on 12 or 24 volts DC nominal bipolar driver voltage at a rate of 50 pulses per second. As shown, motor 134 is a direct-drive stepper motor. A rotor assembly (not shown) is directly coupled to the pinion shaft 144, which is directly coupled to the piston 122. Thus, there are no gears or other mechanical means used to multiply motor torque.

The CDU 132 generally includes a housing 180 that can either be mounted directly to the ESR valve assembly 28 as shown in FIGS. 2 and 3 or can be spaced apart from the ESR valve assembly 28 as shown in FIGS. 4 and 5. Mounting the CDU 132 directly to the ESR valve assembly 28 obviates the requirement of a wiring harness running from each CDU 132 to each ESR valve assembly 28. A communication line 200 and power line connected in a daisy-chain relationship may be used to connect the ESR valve assemblies 28, eliminating the need to run individual communication lines 200 to the main refrigeration controller 30. In addition, mounting the CDU 132 directly to the ESR valve assembly 28 ensures that the CDU 132 is properly wired to the ESR valve assembly 28 as the wiring is performed by the manufacturer during assembly.

If the housing 180 is spaced apart from the ESR valve assembly 28, the CDU 132 may be in communication with the ESR valve assembly 28 by any suitable communication method. For example, the CDU 132 may be wired directly to the ESR valve assembly 28 such that communication between the CDU 132 and the ESR valve assembly 28 is effectuated by a wired connection. Alternatively, the CDU 132 may be wirelessly linked to the ESR valve assembly 28 to allow the CDU 132 to be remotely located from the ESR valve assembly 28. Lines 201 schematically represent wired or wireless communication between the CDU 132 and the ESR valve assembly 28 (FIGS. 4 and 5). In either scenario, a network cable 200 and power line may connect the ESR valve assemblies 28 in a daisy-chain manner.

The CDU controller 132 includes a processor 183, driver circuit 185, memory 187, communication port 188, analog input 189, operation LEDs 190, communication LEDs 191 and position LEDs 192. The CDU controller 132 further includes a data bus 194 providing communication between the processor 183, driver circuit 185, communication port 188, analog input 189, and LEDs 190, 192, as well as one or more other ESR valves 28 and the main refrigeration controller 30. The CDU 132 further includes a power supply circuit 196 connected to the electrically conductive pins 142 to supply power to the motor 134. The power supply circuit 196 is monitored by the CDU controller 132. The housing 180 includes ports for the electrically conductive pins 142, an opening for an access door 198, and one or more ports for a communication line 200 connecting the ESR valve assembly 28 to the daisy chain circuit 35. It should be understood that the above relationship is exemplary and that some components of the CDU 132 may be arranged differently.

In one arrangement, the analog input 189 may be positioned separate from the CDU 132. For example, if the CDU 132 is positioned on the valve assembly 28, the analog input 189 may be in communication with the CDU 132, but does not necessarily have to be disposed within housing 180.

The access door 198 provides access to the CDU 132 and, more particularly, the communication port 188, which can be any known communication port including serial, infrared, etc. Further, a wireless communication protocol, such as Bluetooth®, available from Bluetooth® Special Interest Group, may be employed for communication between the CDU 132 and valve 110, or between the CDU 132 and another device. The access door 198 also provides access to address dip switches for the particular ESR valve assembly 28.

The operation LEDs 190, communication LEDs 191 and position LEDs 192 provide visual indicators of ESR status or diagnostics. For example, field service technicians, can determine if the valve 110 is being driven in either the open or closed direction by inspecting LEDs 190, 191, 192. Such inspections may determine whether the valve 110 is in a fully open or fully closed position, as well as whether the valve 110 has been commanded to reposition itself but does not react to the command. Specifically, the operation LEDs 190 indicate whether CDU 132 is operating or failed. The communication LEDs 191 indicate whether data is being communicated, including whether data is being sent or received. The position LEDs 192 indicate whether the valve 110 is being driven open or closed, or whether the valve 110 is stuck.

Turning now to FIG. 4, the piston 122 is illustrated in greater detail in a cross-sectional view. The piston 122 includes a first end 154 that is adapted to be coupled to the pinion shaft 144. As shown, the piston first end 154 is threaded to receive the threaded pinion shaft 144 to directly couple the actuator output to the piston 122. The piston 122 further includes a second end 156 that has a seat assembly 158 coupled thereto. The seat assembly 158 includes a seat disc 160, which is received in an annular channel 161 defined by a seat disc carrier 162. A flow characterizer 163 may further be coupled to the seat disc 160.

The valve 110 may be required to completely stop fluid flow from the inlet 128 to the outlet, for example, when defrosting a refrigerated grocery case. To provide a tight shut-off, the seat disc 160 must mate properly with a valve seat 164 defined by the body 124. Achieving a tight shut-off and preventing internal leaks requires extremely stringent dimensional tolerances and assembly processes on many of the components involved in creating the shut-off seal. Such precise manufacturing requirements naturally increase the cost of the device. The seat assembly 158 is configured such that it articulates about the piston second end 156 to compensate for manufacturing and variation to improve producability.

As illustrated in FIG. 4, the second end of the piston 156 defines a rounded shoulder 165 having a spherical radius (shown in phantom lines and designated by reference 159) that tapers to a generally cylindrical portion 166. The cylindrical portion 66 defines a diameter that is smaller than the inside diameter of the seat disc carrier 162. The seat disc 162 abuts the rounded shoulder 165 such that a seal is formed. A washer 167 may be placed about the shoulder 165, so that the seat disc 162 actually seals against the washer 167. A spring washer 168 and a washer 169, respectively, are placed about the piston cylindrical portion 166, with the wave washer 169 seating against the characterizer 163, opposite the seat disc 160. A retaining ring 170 is received in an annular groove 171 defined by the cylindrical portion 166 to secure the seat assembly 158 about second end of the piston 156. Securing the seat assembly 158 in this fashion allows the seat assembly 158 to articulate about the cylindrical portion 166 of the second end of the piston 156. This "ball-and-socket" movement is facilitated by the spherical radius 159 of the rounded shoulder 165, allowing the carrier 162 to maintain a seal against the piston 122 when the seat assembly 158 is moved about second end 156.

The characterizer 163 defines an inside diameter larger than the cylindrical portion 166. The larger inside diameter along with securing the seat assembly 158 via the spring washer 168, the washer 169, and the retaining ring 170, allows the characterizer 163 to slide laterally and align itself with the valve body seat 164. This further relaxes the dimensional precision required, and compensates for manufacturing variations.

The piston 122 also includes a sliding seal 172 that, in one embodiment of the teachings, is spring loaded. The sliding seal 172 may be constructed of an elastomeric or thermoplastic material as is readily known in the art. The sliding seal 172 is held in place on a shoulder 174 by a washer 176 and a retaining ring 178 in a groove 179. The sliding seal 172 forms a lip seal against the opening 123 of the body 124 as the piston 122 reciprocates therein.

The pressure above and below the piston 122 is balanced to reduce the output force required for the motor 120 to move the piston 122. The bottom of the motor housing 138, the inside wall of the axial opening 123 of the body 124, and the shoulder 174 define a chamber 181. The piston 122 defines a longitudinal aperture 122 and a cross aperture 184 connected to the longitudinal aperture 122. The apertures 122, 184 provide a fluid path from the inlet 128 to the chamber 181, to equalize the pressure on the first and second ends 154, 156 of the piston 122.

It is important that the valve 110 be properly sealed to prevent undesirable fluid flow from the inlet tube 128 to the outflow tube 130 and also from the valve 110 to the surrounding environment. In addition to the sliding seal 172 of the piston 122, several other sealed connections cooperate to accomplish this task. More particularly, the motor housing 138 and the top cap assembly 140 of the motor assembly 120 shown in FIG. 3 are hermetically sealed in the specific embodiment illustrated therein. Further, threaded connections between the motor housing 138 and the bell 125, and the bell 125 and the tube portion 126 of the body 124 (best shown in FIG. 2) are sealed by operation of knife-seals 186 in a manner well known to the art. This metal-to-metal seal design eliminates the need for external sealing o-rings, and in turn, eliminates the failures associated with o-rings. The connection between the electrical controller 132 and the motor assembly 120 is sealed by applying silicone RTV, silicone dielectric gel, or other similar sealing media around the periphery of the electrical controller 132 where it contacts the surface of the motor assembly 120.

Actuation of the valve 110 is controlled through appropriate power regulation by a control algorithm executed at a main refrigeration controller 30 or by the CPU 132 based on monitoring operating parameters such as a thermistor (temperature sensor 44 or display module 46) or transducer (pressure transducer 36). Either the CDU controller 132 or main refrigeration controller 30 executes a control software algorithm in order to send valve position signals to the driver circuit 183, which regulates power to the motor 134. Referring once again to FIG. 2, the motor 134 moves actuator 152, which moves the piston 122 linearly and bi-directionally within the axial opening 123 in a stepwise fashion to open and close the ESR valve assembly 28. The linear, bi-directional, stepwise motion of piston 122 enables control over fluid flow through the ESR valve assembly 28.

Each ESR valve assembly 28 may be controlled in at least one of three ways. Specifically, each ESR valve assembly 28 may be controlled based upon pressure readings via the pressure transducer 36, based upon one or more temperature readings via the temperature sensor 44, or based on a simulated product temperature. Further, diagnostic algorithms for each ESR valve assembly 28 may be executed by the CDU 132 to indicate operating conditions or predict system failure. The various algorithms for controlling the valve 110 may be of the type described in Assignee's U.S. patent application Ser. No. 09/539,563 filed on Mar. 31, 2000, now U.S. Pat. No. 6,360,553, the disclosure of which is hereby incorporated herein by reference.

The CDU 132 may include a valve position algorithm to determine a valve position or direction of valve movement, such as whether the valve 110 is open or closed and/or whether the valve is being driven open or driven closed. The Hall Effect sensor 137 in combination with the CDU 132 and/or the main refrigeration controller 30 may verify whether the valve 110 is actually in the position to which it has been controlled. Alternatively, motor current may be monitored to determine a valve position or diagnose a valve condition.

Monitoring drive current of the stepper motor 134 of the valve 110 when the valve 110 is at either the fully open or fully closed position may also be used to determine valve position. The CDU 132 may monitor the power supply circuit 196 to detect a change in the current (approximately thirty percent) for about five to ten milliseconds. An analog-to-digital sample at a rate of approximately one sample every millisecond will detect a dip in current at a fully open or fully closed position, or if the valve assembly 28 is stuck due to debris.

Determining when the valve 110 is fully open or fully closed is difficult during normal valve control because the driver circuit 185 does not receive valve position feedback data. Thus, the exact position of the valve 110 must be determined by monitoring other parameters.

One method of valve control is to over-drive the valve closed to ensure it is fully closed or fully open, and then to record steps to a desired position from that known fully open or fully closed position. Such control may be useful during start-up and initialization of the ESR valve assembly 28. For example, during start-up and/or installation, the ESR valve assembly 28 may be "self-calibrated" by first cycling the valve 110 to the fully open or fully closed position and then driving the valve 110 to the other of the fully open or fully closed position. The steps taken by the valve 110 between the fully open and fully closed positions may be counted by monitoring current and/or through use of the Hall Effect Sensor 137. The recorded steps may then be used by the CDU 132 in determining the true position of the valve 110 during normal use. It should be noted, however, that care should be taken in over-driving the valve 110 as such operations may cause the valve 110 to stick, especially if left in a particular position for a longer period of time (i.e., during defrost). Backing off of the valve 110 a few steps after overdrive prevents sticking, but may allow blow through of hot gas during defrost.

Monitoring current with a current sensor allows detection of the fully open or fully closed valve position without any change to the valve design, which allows the method to be applied to valves already in service. The fully open, fully closed, or stuck position may be detected by analyzing the current waveform of the drive current. During normal operation, the current exponentially ramps up, and then maintains a current value for the duration of the pulse. At the valve-position extremes (i.e., fully open or fully closed), the current starts the exponential ramp-up, but then dips by about thirty percent for five to ten milliseconds. The same exponential ramp-up and dip is detected when a valve 110 is stuck. By placing a small resistor (<1 ohm) in the leg of the drive to the valve, the voltage across the resistor may be amplified with an op-amp and then read with an A/D converter associated with the CDU 132. The CDU 132 may sample the signal approximately once every millisecond as the pulse drive is applied. With software stored in the memory 187, the dip in current may be detected and the appropriate action may be taken. It should be understood that in addition to current detection, other methods for gathering valve position or current data may be employed. The current data, once obtained by the CDU 132, may be transmitted to the main refrigeration controller 30 for a diagnostic analysis.

Current detection also allows the CDU 132 to determine various fault conditions associated with the ESR valve assembly 28. For example, if a wire is severed, disconnected from the ESR valve assembly 28, or disconnected from the CDU 132, a drop in current may be detected by the CDU 132. Such information may be transmitted to the main refrigeration controller 30 and used as a diagnostic tool.

The valve position may also be determined through use of the Hall Effect Sensor 137, which detects the position of the valve 110 and communicates the position to the analog input 189 of the CDU 132. The CDU 132 may further communicate the valve position to the main refrigeration controller 30 to confirm the actual valve position with the controlled position determined by the CDU 132 or the main refrigeration controller 30. The Hall Effect sensor 137 is supplied with a supply voltage and a reference voltage from the CDU 132, and further includes a ground terminal. The sensor 137 includes a silicone chip placed at a right angle to a magnetic field for determining a voltage change based on the position of the valve 110. An amplifier and voltage regulator may also be provided by the CDU 132.

Control techniques using the valve position data may also be used to clear a valve 110 that is stuck due to debris. If a fully open or closed condition occurs before expected, the CDU 132 may back the valve 110 off a few steps before attempting to achieve the desired position again, whereby any debris may be dislodged. If the stuck condition remains, the valve 110 may be driven to one of the extreme positions (fully open or fully closed), and then steps may be counted to provide a diagnostic assessment. If the step count to the opposite extreme is less than the expected step count, the CDU 132 may predict a debris condition and issue an alarm.

Control techniques can be automatically performed by the controller 132 upon detection of the stuck-valve condition or can be performed "manually" by allowing a technician to remotely cycle the valve assembly 28 between the open and closed positions. For example, when a stuck-valve condition is detected, the CDU 132 may automatically cycle the valve 110 between the open and closed positions in an attempt to clear the debris. Alternatively, the CDU 132 may notify a technician of the stuck-valve condition to allow the technician to remotely cycle the valve 110 between the open and closed positions.

Regardless of the position and/or control strategy, the CDU 132 may drive the valve 110 to the controlled position repeatedly if it does not react or attain the initially instructed valve position. A warning may be sent to the main refrigeration controller 30 or annunciated via position LED 192 at the ESR valve assembly 28. In this way, valve malfunctions may be reported earlier than by monitoring temperature conditions (symptom) in a refrigeration case. Earlier diagnostics of such malfunctions may prevent food spoilage or damage to the compressor rack 18.

The description of the teachings is merely exemplary in nature and, thus, variations that do not depart from the gist of the teachings are intended to be within the scope of the teachings. Such variations are not to be regarded as a departure from the spirit and scope of the teachings.

What is claimed is:

1. A method comprising:

cycling an electronic evaporator pressure regulator valve fluidly coupled to a refrigeration circuit to regulate flow through said electronic evaporator pressure regulator valve;

sensing a current drawn by said electronic evaporator pressure regulator valve during cycling of said electronic evaporator pressure regulator valve between a fully open position and a fully closed position to determine a baseline number of steps of valve movement between said fully open position and said fully closed position;

sensing current drawn by said electronic evaporator pressure regulator valve during normal use to determine a number of steps of valve movement between said fully open position and said fully closed position;

comparing said determined number of steps of valve movement during normal use to said baseline number of steps; and determining a valve condition of said electronic evaporator pressure regulator valve based on said comparison.

2. The method of claim 1, wherein determining a valve condition includes detecting a stuck-valve condition.

3. The method of claim 2, further comprising automatically cycling said electronic evaporator pressure regulator valve between a first stop position and a second stop position to remedy said stuck-valve condition.

4. The method of claim 3, wherein said first stop position is one of said fully open position and said fully closed position and said second stop position is the other of said fully open position and said fully closed position.

5. The method of claim 2, further comprising setting an alarm when said stuck-valve condition is detected.

6. The method of claim 2, further comprising manually cycling said electronic evaporator pressure regulator valve between a first stop position and a second stop position to remedy said stuck-valve condition.

7. The method of claim 6, wherein said first stop position is one of said fully open position and said fully closed position and said second stop position is the other of said fully open position and said fully closed position.

8. The method of claim 1, wherein determining a valve condition includes determining at least one of a broken-wire condition or a loose-wire condition when said current drawn during normal use is outside of a predetermined range.

9. The method of claim 1, wherein determining a valve condition includes determining a valve position.

10. The method of claim 9, wherein said valve position includes at least one of said fully open position, said fully closed position, and any position between said fully open position and said fully closed position.

11. The method of claim 1, wherein determining said baseline number of steps is performed at installation of said electronic evaporator pressure regulator valve.

12. The method of claim 1, wherein at least one of said determining said baseline number of steps and said determining said determined number of steps of value movement during normal use includes using a Hall Effect Sensor.

* * * * *

UNITED STATES PATENT AND TRADEMARK OFFICE

CERTIFICATE OF CORRECTION

PATENT NO. : 7,669,432 B2
APPLICATION NO. : 11/874506
DATED : March 2, 2010
INVENTOR(S) : Albert W. Maier et al.

It is certified that error appears in the above-identified patent and that said Letters Patent is hereby corrected as shown below:

| | |
|---|---|
| Column 4, Line 43 | After "may," delete "be." |
| Column 7, Lines 60-61 | "cylindrical portion 66" should be --cylindrical portion 166--. |
| Column 8, Line 33 | "longitudinal aperture 122" should be --longitudinal aperture 182--. |
| Column 8, Line 34, | |
| First occurence | "longitudinal aperture 122" should be --longitudinal aperture 182--. |
| Second occurrence | "The apertures 122" should be --The apertures 182--. |
| Column 12, Line 34 | "value" should be --valve--. |

Signed and Sealed this

Thirtieth Day of November, 2010

David J. Kappos

David J. Kappos
*Director of the United States Patent and Trademark Office*